US006481040B1

(12) United States Patent
McIntyre

(10) Patent No.: US 6,481,040 B1
(45) Date of Patent: Nov. 19, 2002

(54) MODULAR SURGICAL PREP SPONGE HOLDER

(76) Inventor: Jonathan L. McIntyre, 910 St. Germain Rd., Chula Vista, CA (US) 91913

( * ) Notice: Subject to any disclaimer, the term of this patent is extended or adjusted under 35 U.S.C. 154(b) by 49 days.

(21) Appl. No.: 09/624,177

(22) Filed: Jul. 24, 2000

Related U.S. Application Data

(60) Provisional application No. 60/153,640, filed on Aug. 31, 1999.

(51) Int. Cl.[7] ..... A46B 13/04; A46B 13/06; A47K 7/04

(52) U.S. Cl. ..... 15/21.1; 15/22.2; 15/29; 15/97.1

(58) Field of Search ..... 15/21.1, 22.2, 15/29, 97.1, 50.2, 68, 74; 4/606

(56) References Cited

U.S. PATENT DOCUMENTS

| | | | | | |
|---|---|---|---|---|---|
| 534,128 | A | * | 2/1895 | Waters | 15/21.1 X |
| 892,934 | A | * | 7/1908 | Carpenter | 15/50.2 |
| 1,038,548 | A | * | 9/1912 | Fietz | 15/22.2 X |
| 1,476,433 | A | * | 12/1923 | Vandervoort | 15/29 X |
| 1,519,530 | A | * | 12/1924 | Chan | 15/50.2 |
| 2,019,705 | A | * | 11/1935 | Hubert | 15/74 |
| 2,345,294 | A | * | 3/1944 | Schauffler et al. | 15/21.1 X |
| 2,540,792 | A | * | 2/1951 | McCready | 15/22.2 X |
| 2,599,273 | A | * | 6/1952 | Mitchell | 15/21.1 X |
| 2,671,914 | A | * | 3/1954 | Rucker | 15/22.2 |
| 3,066,336 | A | * | 12/1962 | Stobbe | 15/21.1 |
| 3,439,370 | A | * | 4/1969 | McLaughlin | 15/21.1 X |
| 3,624,854 | A | * | 12/1971 | Strong | 15/97.1 |
| 3,699,984 | A | | 10/1972 | Davis | 134/95.2 |
| 3,966,335 | A | | 6/1976 | Abramson | 401/10 |
| 4,219,367 | A | | 8/1980 | Cary, Jr. et al. | 134/29 |
| 4,336,619 | A | | 6/1982 | Hinkel et al. | 4/619 |
| 4,542,549 | A | * | 9/1985 | Keller | 15/22.2 X |
| 4,704,756 | A | * | 11/1987 | Williams et al. | 15/21.1 |
| 4,866,806 | A | | 9/1989 | Bedford | 15/104.94 |
| 4,942,631 | A | | 7/1990 | Rosa | 4/623 |
| 5,165,132 | A | * | 11/1992 | Giorgio et al. | 15/22.2 |
| 5,412,816 | A | | 5/1995 | Paterson et al. | 4/623 |
| 6,029,292 | A | * | 2/2000 | Leiferman et al. | 4/606 X |

FOREIGN PATENT DOCUMENTS

| | | | | |
|---|---|---|---|---|
| DE | 915548 | * | 7/1954 | 15/50.2 |
| FR | 1130499 | * | 2/1957 | 15/50.2 |
| GB | 345861 | * | 4/1931 | 15/29 |

* cited by examiner

*Primary Examiner*—Mark Spisich
(74) *Attorney, Agent, or Firm*—Freling Baker

(57) ABSTRACT

A modular surgical prep sponge holder is provided for improving the cleaning of hands and arms prior to medical procedures. The device includes a tubular member containing a flexible cable and a flexible water line that extend through the tube. A rotating head is attached to the end of the tube, which moves 180 degrees in any direction. The disposable part of the device, being encased in a plastic housing, is connected to the rotating head. The housing includes a main gear, and a movement-plate with end clasps. Once the housing is inserted onto the end of the flexible cable, and a motor is turned on, the flexible cable will rotate. The rotational motion of the flexible cable will be transferred to the main gear and will be converted to lateral motion, causing the movement-plate to move in a lateral direction. Depending upon the setting of the motor, the system may deliver several hundred more strokes per minute than could manually be performed by an individual. Prior to turning on the system, the swivel head will receive a packaged sterile unit. After unwrapping the unit and attaching it to the swivel, the unit will receive a sterile surgical sponge. The rapid back and forth motion of the device will improve efficiency, reduce the chance for cross contamination, and allow for a hands-free, tireless surgical prep while maintaining the integrity of the current practice of cleaning the hands and arms prior to surgery.

21 Claims, 4 Drawing Sheets

MODULAR SURGICAL PREP SPONGE HOLDER

PRIORITY

This application relies for priority upon United States Provisional Application No. 60/153,640, filed on Aug. 31, 1999, the contents of which are herein incorporated by reference in their entirety.

BACKGROUND OF THE INVENTION

The present invention relates to a hand cleaning process and related unit that can easily be adapted to existing sinks, using existing cleansing materials, such as soap and sponges. More particularly, the present invention relates to a hand cleaning process for use in an operating room or medical setting that effectively improves the effectiveness of hand cleaning, which is performed by physicians and by other operating room or medical personnel prior to a surgery or medical procedure.

In general, a surgical prep sponge is used to clean the hands and arm area of a doctor or other medical professional prior to them participating in surgery. Although called a sponge, a surgical prep sponge is actually a combination of a sponge and a brush. The sponge portion can hold water and soap, and the brush can be used for scrubbing the user's hands and arms.

Cleanliness of the hands, arms and fingernails is extremely critical in the operating room or in any medical setting where the hands enter a body cavity of another individual. In this type of cleaning process, a surgical prep sponge is generally held in one hand and used to brush against the other hand and arm in a back and forth cleaning motion. Recently, a sponge embedded with a cleaning agent has come into common use. After being wetted, a sudsing action occurs on the surface of the sponge, creating a germicidal reaction that cleans the hands.

It is known in the art that a good surgical prep is largely responsible for preventing the spread of bacteria entering through an open cavity or wound in a body during a surgical or medical procedure. It is also well known that increasing the time, agitation, and number of strokes involved in the scrubbing motion of a surgical prep, will directly reduce the number of bacteria present after the scrubbing.

Previously, a surgical prep sponge has been held in one hand to scrub the other hand and then transferred to the second hand to scrub the first, once the second hand is clean.

However, this process leaves open the possibility of cross contamination since the person scrubbing their hands must take hold of the non-sterile sponge with their just-cleaned hand before they can clean their other hand. Any bacteria that may have been deposited on the sponge by the user's second hand could then be transferred to the user's first hand, undermining the entire cleaning process.

Then, when the cleaning process is complete, the medical professional must use one hand to throw away the used sponge, meaning that at least one of the user's hands will have touched the non-sterile sponge after the cleaning process, leaving open the possibility of cross contamination.

Although the chance of such cross contamination resulting from this is small, it does remain as a potential source of infection for the patient, and so should be avoided if possible.

In addition, since the scrubbing action is performed by hand, it may be non-uniform, or shorter than a desired duration. If the person cleaning their hands is tired, or dislikes the repetitive back and forth motion, they may use fewer or less vigorous strokes than would be preferable for an effective cleaning process.

Furthermore, although surgical preparation is a situation in which the concern with cleanliness is great, it is by no means the only venue that could benefit by an improved hand washing system. Any hospital or other medical or dental facilities has a need to minimize the spread of infectious bacteria and will be concerned with cleanliness, particularly with regards to the hands of the medical staff.

Similarly, with the threat of such communicable diseases as hepatitis A, the food preparation and production industry has a similar need to secure a better means to improve their cleanliness in order to reduce the risk that any disease will be spread. And any job that requires cleanliness, either before or after work, whether it be at a tissue bank, in a clean room environment, in a factory environment, or the like, could benefit from an improved hand washing technique.

Furthermore, there are some people who are handicapped, whether temporarily or permanently, and have lost all or part of the use of their hands. For these people it would be desirable to have a method by which they could quickly and effectively wash their hands, whether it be at home, at work, or while traveling.

These problems can be solved by using a cleaning device disclosed in the present invention, improvements in function are immediately obvious.

SUMMARY OF THE INVENTION

It is an object of the invention to improve or eliminate the aforementioned problems accompanied with the conventional method of scrubbing for a surgical or medical procedures, in which a surgical scrub sponge is used, without causing major changes in the current methods for preparing for a medical procedure.

According to the invention, a modular surgical prep sponge holder is provided, This modular surgical prep sponge holder comprises a movement-plate, a surgical sponge connected to the movement-plate, a lateral motion generator for moving the movement-plate and the surgical sponge in a lateral direction, and a water line for supplying water to the surgical sponge.

The lateral motion generator may comprise a wheel, a rotational motion generator for moving the wheel in a rotational direction, a motion transfer device to convert rotational movement of the wheel into lateral movement of the movement-plate.

The transfer device preferably comprises a drive shaft pin connected to the wheel; the movement-plate preferably contains a drive-pin slot; and the drive shaft pin is preferably placed within the drive-pin slot to convert the rotational movement of the wheel into the lateral movement of the movement-plate.

The rotational motion generator can be controlled by a device operable by a foot or leg. The rotational motion generator may comprise a flexible shaft connected to the wheel, the flexible shaft being rotated to provide the rotational movement of the wheel. The rotational motion generator may also comprise a stream of high-pressure water that pushes against the wheel, causing the wheel to move in the rotational direction.

The wheel is preferably a main gear. In this case, the rotational motion generator may comprise a pinion gear connected in an interlocking fashion with the main gear, and a flexible shaft connected to the pinion gear, wherein the flexible shaft is rotated to provide rotational movement to the pinion gear, and the rotational movement of the pinion gear is transferred into the rotational movement of the main gear.

The movement-plate and the lateral motion generator are preferably placed within an outer housing. The flexible shaft and the water line are both preferably contained within a tube housing. The amount of water supplied to the surgical sponge can be controlled by a device operable by a foot or leg. And the modular surgical prep sponge holder may further comprise a soap dispenser for dispensing cleansing agents.

The modular surgical prep sponge holder may further comprise a swivel head connected to the movement-plate, the swivel head allowing the movement-plate to move along 180 degrees of motion. The sponge is preferably attached to the movement-plate through the use of spring tension end clasps.

In addition, a cleaning device is provided in accordance with this invention. The cleaning device comprises a movement-plate; a sponge connected to the movement-plate; a lateral motion generator for moving the movement-plate and the sponge in a lateral direction; and a water line for supplying water to the sponge.

The lateral motion generator may itself comprise a wheel; a rotational motion generator for moving the wheel in a rotational direction; and a motion transfer device to convert rotational movement of the wheel into lateral movement of the movement-plate.

The cleaning device may further comprise a housing cover to protect the movement plate; and a swivel head connected to the housing cover, the swivel head allowing the housing cover to move along 180 degrees of motion.

BRIEF DESCRIPTION OF THE DRAWINGS

The above and other objects and advantages of the present invention will become readily apparent from the description that follows, with reference to the accompanying drawings, in which.

DETAILED DESCRIPTION OF THE PREFERRED EMBODIMENT

The present invention provides an improved method and apparatus for hand cleaning before an invasive surgical procedure. This method and apparatus can significantly improve the quality of surgical hand preparation prior to surgery in a medical or dental procedure.

Figure 1:
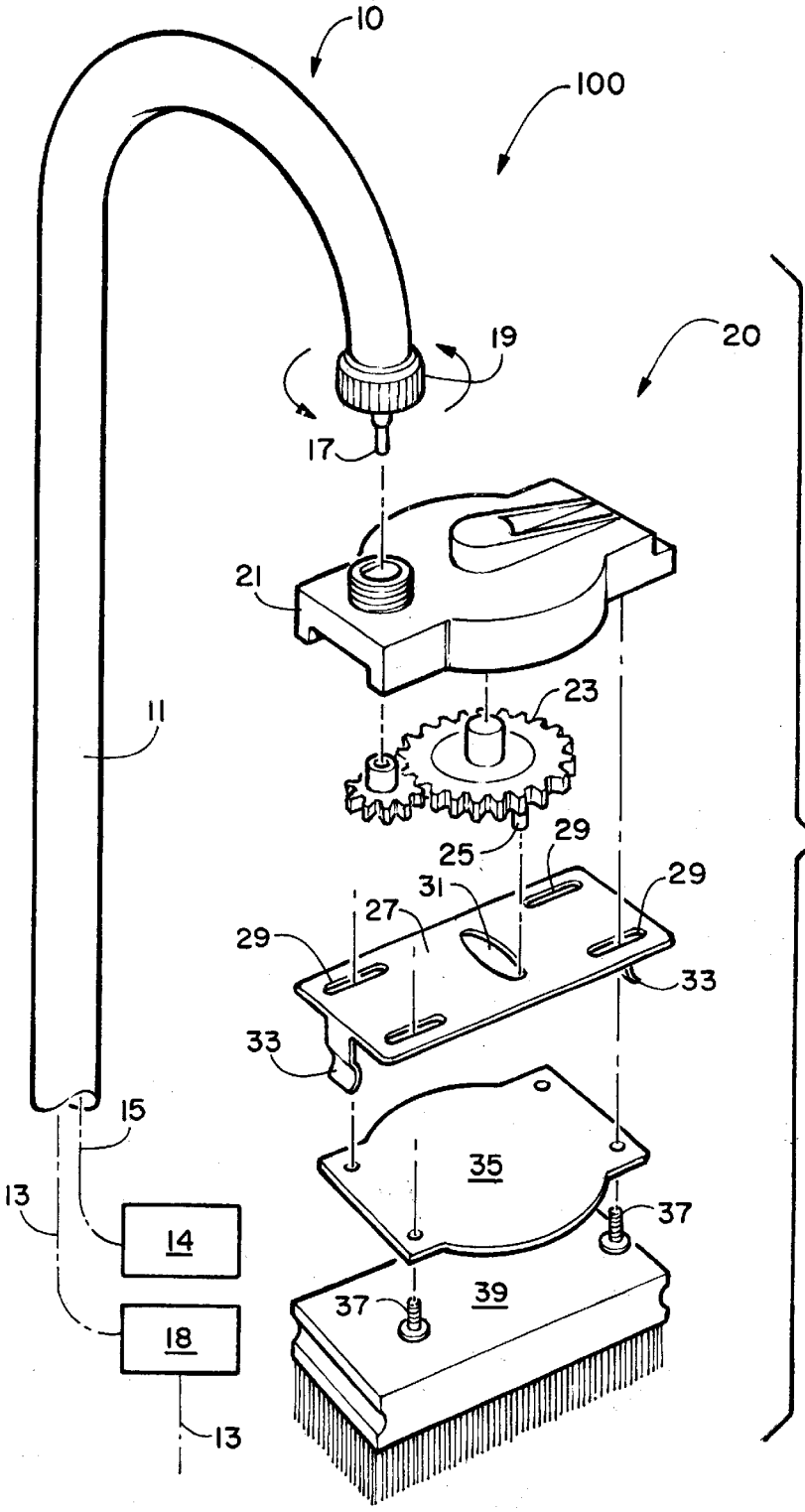
FIG. 1 is an exploded view of a modular surgical prep sponge holder according to a first preferred embodiment of the present invention.
Figure 2:
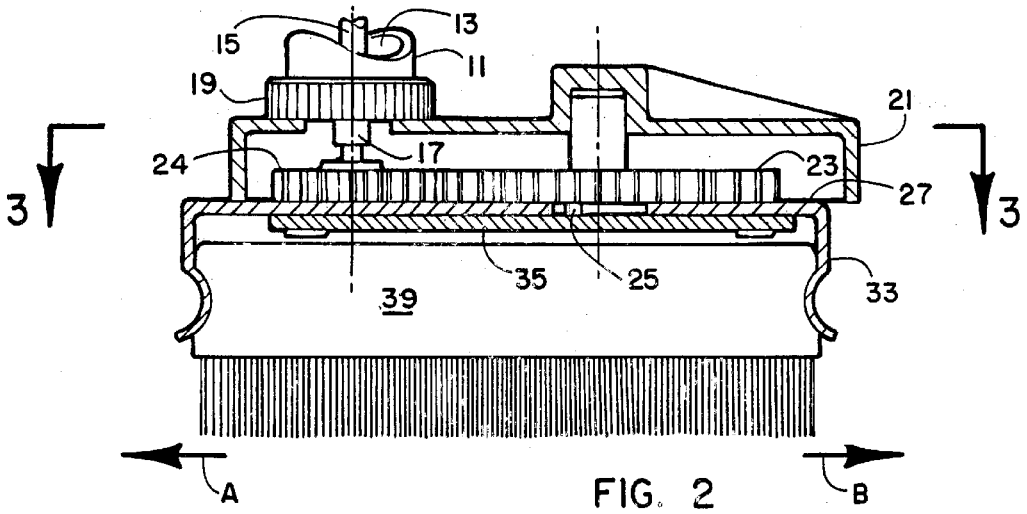
FIG. 2 is a side view of the modular surgical prep sponge holder of FIG. 1 in operation.
Figure 3:
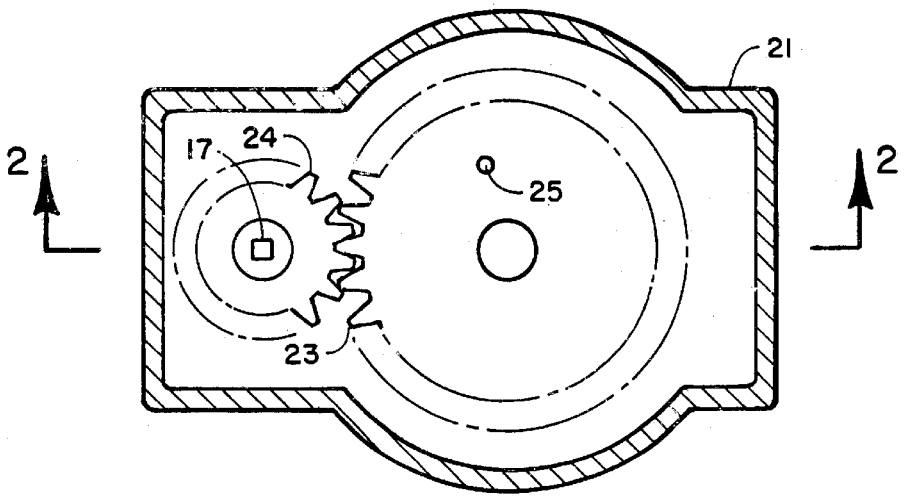
FIG. 3 is a plan view of the unit housing cover and gears from FIG. 1.

The present invention will now be described in detail with reference to a first preferred embodiment shown in FIGS. 1–3. FIG. 1. is an exploded view of a modular surgical prep sponge holder according to the first preferred embodiment of the present invention; FIG. 2 is a side view of the modular surgical prep sponge holder of FIG. 1; and FIG. 3 is a plan view of the unit housing cover and gears from FIG. 1.

As shown in FIGS. 1 and 2, the modular surgical prep sponge holder 100 includes a permanent portion 10 and a removable portion 20. The permanent portion 10 includes a tubular member 11, a water line 13, a flexible shaft 15, a flexible shaft attachment 17, and a swivel head 19.

The tubular member 11 contains both the water line 13 and the flexible shaft 15. It preferably comprises a stainless steel tube, either telescopic or standard, having an inner diameter of about 20 mm. However, it is primarily required that the structure of the tubular member 11 be sufficient to support both the flexible shaft 15 and the water line 13, which each run inside the length of the tubular member 11. As a result, any design that allows for such support would be acceptable. The water line may be made of plastic or any other suitable material.

The amount of water flowing through the line 13 may be controlled by the user by any conventional means. In addition, liquid soap from a reservoir 18 may be fed into line 13 and to the prep sponge holder. An electric motor 14 drives the flexible shaft 15 to drive the sponge holder. As is conventional, the motor speed may be controlled by the user.

The swivel head 19 is attached to the end of the tubular member 11, and acts to secure the removable portion 20 to the permanent portion 10. The swivel head 19 also allows the removable portion 20 to be moved into a variety of positions to allow for improved cleaning process. Preferably, the swivel head 19 is able to move in any direction along 180 degrees of motion, allowing the removable portion 20 an equal freedom of motion.

The flexible shaft 15 ends in the flexible shaft attachment 17, which sticks out of the end of the tubular member 11 and through the swivel head 19. Both the flexible shaft 15 and the flexible shaft attachment 17 can be rotated by a motor 14 or the like. The flexible shaft attachment 17 attaches to the removable portion 20.

The removable portion 20 includes a unit housing cover 21, a main gear 23, a movement-plate 27, an end clip 33, a unit housing bottom 35, and a surgical prep sponge 39. The main gear 23 has a drive shaft pin 25 attached to it along its circumference, at a given radius. The movement-plate 27 includes a plurality of positioning holes 29 and a movement-plate drive-pin slot 31. The unit housing bottom 35 includes a plurality of fixing mechanisms 37.

When this application refers to a surgical prep sponge, it can mean a sponge, a brush, or a combination sponge/brush used for cleaning hands and arms. Furthermore, the present invention should not be limited to the use of surgical prep sponges. Any kind of sponge or brush used for cleaning is intended to fall within the scope of this invention.

To further limit the possibility of contamination, the removable portion 20 can be disposed of and replaced periodically, or can be removed and sterilized using another process.

The unit housing cover 21, which serves as a top to the removable portion 20, is secured to the swivel head 19, and is preferably attached to the flexible shaft attachment 17 in an interlocking relationship. Preferably the unit housing cover is made of a disposable plastic.

As shown specifically in FIG. 3, in the first preferred embodiment the unit housing cover 21 contains two gears, a main gear 23 and a pinion gear 24. The drive shaft pin 25 is connected to the main gear 23 somewhere along the circumference of the main gear 23. The pinion gear 24 has its shaft connected to the flexible shaft attachment 17, and is rotated by the flexible shaft attachment 17.

In this embodiment, the main gear 23 is preferably a PIC molded 24-pitch spur gear, although any suitable gear may be used. The pinion gear 24 is preferably a smaller gear that drives the larger main gear 23.

In the first preferred embodiment, one end of the flexible shaft attachment 17 will include a square-shaped piece of material that is inserted through the unit housing cover 21 and be attached snugly and into a square opening on the pinion gear 24. Thus, as the flexible shaft attachment 17 turns, so too will the pinion gear 24 turn. And as the pinion gear 24 moves, so too will the main gear 23.

Figure 4:
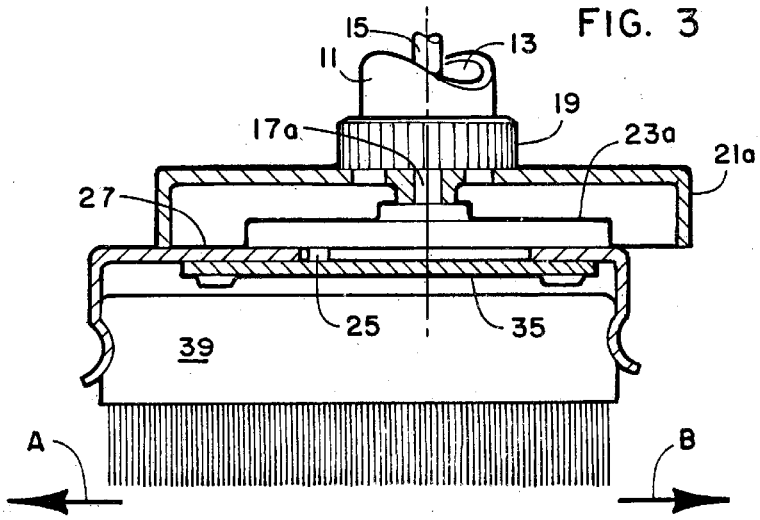
FIG. 4 is a side view of a modular surgical prep sponge holder according to a second preferred embodiment of the present invention.
Figure 5:
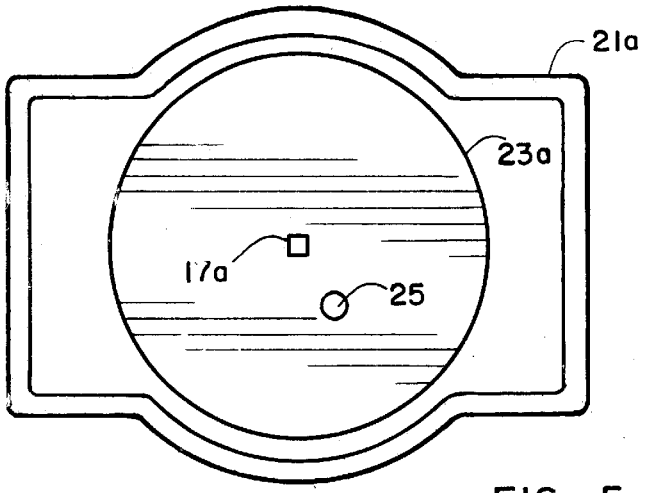
FIG. 5 is a plan view of the unit housing cover and gears from FIG. 4.

FIGS. 4 and 5 show a second preferred embodiment of the present invention. FIG. 4 is a side view of a modular surgical prep sponge holder according to the second preferred embodiment of the present invention, and FIG. 5 is a plan view of the unit housing cover and gears from FIG. 4.

The second preferred embodiment is substantially similar to the first preferred embodiment, except that it uses only a main gear 23, and does not employ a pinion gear. As shown in FIG. 4, the drive shaft pin 25 is connected to the main gear 23 somewhere along the circumference of the main gear 23. The main gear 23 has its shaft connected to a flexible shaft attachment 17*a*, which is identical to the flexible shaft attachment 17 of the first preferred embodiment, except for its position. The main gear is then directly rotated by the flexible shaft attachment 17*a*.

The unit housing cover 21*a* in the second preferred embodiment is substantially similar to the unit housing cover 21 in the first preferred embodiment. However, it is secured to the swivel head 19 above the main gear 23, and may be of a slightly different size or shape to account for there being no need to accommodate a pinion gear. As in the first preferred embodiment, the unit housing cover 21*a* is preferably attached to the flexible shaft attachment 17*a* in an interlocking relationship.

Although the first preferred embodiment disclosed in FIGS. 1–3 uses two gears, a main gear 23 and a pinion gear 24, and the second preferred embodiment uses a single gear, a main gear 23, alternate embodiments may also be used. For example, the unit could also use multiple pinion gears to drive a single main gear.

In both the first and second preferred embodiments, the movement-plate 27 includes a plurality of positioning holes 29 and a single drive-pin slot 31. The positioning holes 29 are used to hold the movement-plate 27 in position during operation. The movement-plate 27 is positioned such that the drive-pin slot 31 is located below the drive shaft pin 25, and contains the drive shaft pin 25 when the removable portion is fully assembled.

As the main gear 23 rotates, so too does the drive shaft pin 25 connected to the main gear 23. The rotational movement of the drive shaft pin 25 is translated into lateral movement for the movement-plate 27 by the movement of the drive shaft pin 25 in the drive-pin slot 31. The ratio of strokes per minute for the movement-plate 27 is thus directly related to the length of the drive pin slot 31, the position of the drive shaft pin 25 on the main gear 23, and the rotational speed of the main gear 23. In particular, the farther out on the main gear 23 that the drive shaft pin 25 is located, the faster the movement-plate 27 will move in a lateral direction.

In the preferred embodiment, the movement plate 27 preferably comprises a polymer plastic plate about 9 cm long, 4.5–6 cm thick, and 3 thick. The length of the drive-pin slot 31 is preferably about 10 mm. The drive shaft pin 25 preferably extends vertically into the drive-pin slot 31 from the gear a total of about 10 mm. The drive shaft-pin 25 is preferably 2 in diameter.

The unit housing bottom 35 is attached to the unit housing cover 21 by means of the plurality of fixing mechanisms 37. These fixing mechanisms preferably pass through the positioning holes 29 in the movement-plate 27 and serve to keep the movement plate 27 in position. In the preferred embodiment the fixing mechanisms 37 are plastic screws or plastic dowels fitted into the housing, although any other suitable means for securing the unit housing bottom 35 to the unit housing top 21 may be used.

The movement-plate 27 is preferably integrally constructed with end clips 33, or clasps, to receive and secure the surgical prep sponge 39. These end clips 33 can be of molded plastic or any other suitable material and shape that will adequately hold the sponge 39 during operation. In the preferred embodiment, the end clips 33 are spring tension end clasps, although any suitable device for fixing the sponge 39 to the movement-plate 27 can be used.

Because the sponge 39 is attached to the movement-plate 27 by means of the end clips 33, the sponge 39 will be held in place and will have the same lateral movement as the movement-plate 27.

The operation of the modular surgical prep sponge holder 100 will now be described with reference to FIGS. 2, 4 and 6A to 6D. FIGS. 6A to 6D show underside views of the movement-plate of FIGS. 2 and 4 in operation.

As shown in FIG. 2, when power is applied in the first preferred embodiment, the flexible shaft 15 and the flexible shaft attachment 17 rotate, causing the pinion gear 24 to rotate, which in turn causes the main gear 23, including the driving shaft pin 25, to rotate.

Similarly, as shown in FIG. 4, when power is applied in the second preferred 15 embodiment, the flexible shaft 15 and the flexible shaft attachment 17*a* rotate, causing the main gear 23, including the driving shaft pin 25, to rotate.

Although in the above preferred embodiments, the rotation of the main gear 23 is obtained by the rotation of the flexible shaft attachment, alternate methods may be used. For example, the flow of water through the device could be used to cause the main gear to rotate. In addition, other methods of rotating the main gear 23 could be used.

Figure 5A:
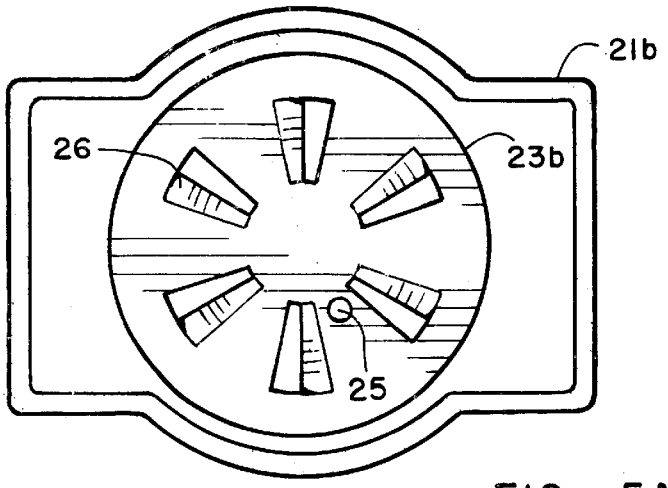
FIG. 5A is a view like FIG. 5 showing a modification for water drive.

FIG. 5A illustrates a modification of the embodiment of FIGS. 4 and 5 to enable the main gear 23*b* to be driven by water pushing against the wheel. Gear or wheel 23*b* is formed with surfaces 26 that function as turbine blades that rotate the gear when water contacts them. The amount of water flowing through the line 13 and to the surfaces 26 and thus the speed of the drive may be controlled by the user by any conventional means.

In both the first and second preferred embodiments, as the driving shaft pin 25 rotates, it moves back and forth in the drive-pin slot 31, causing the movement-plate 27 to move back and forth in a lateral direction, as shown by the arrows marked "A" in FIGS. 2 and 4. The movement of the movement-plate 27 is transferred to the end clips 33 and then to the surgical prep sponge 39, since all three are attached together.

Figure 6A:
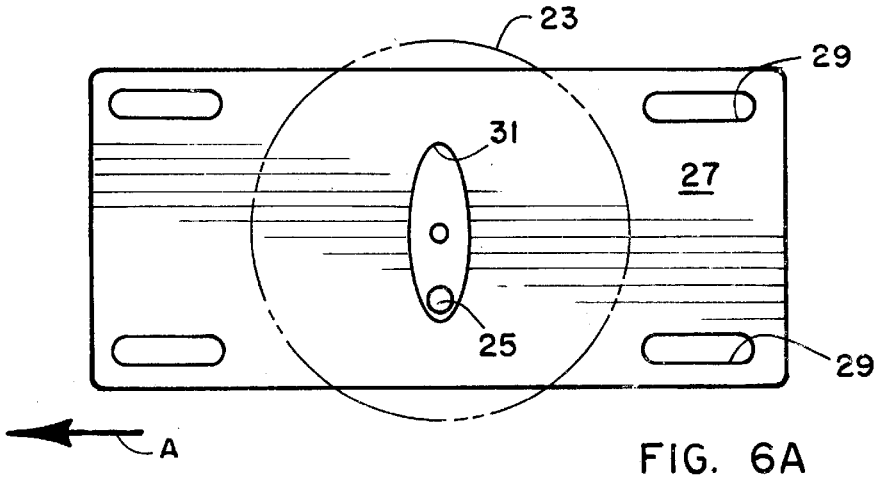
FIGS. 6A to 6D show underside views of the movement-plate of FIGS. 2 and 4 in operation.
Figure 6B:
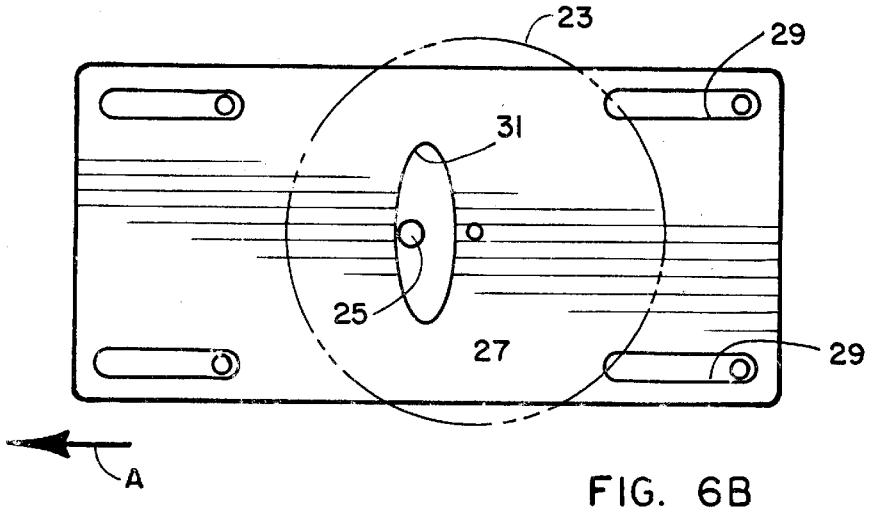
Figure 6C:
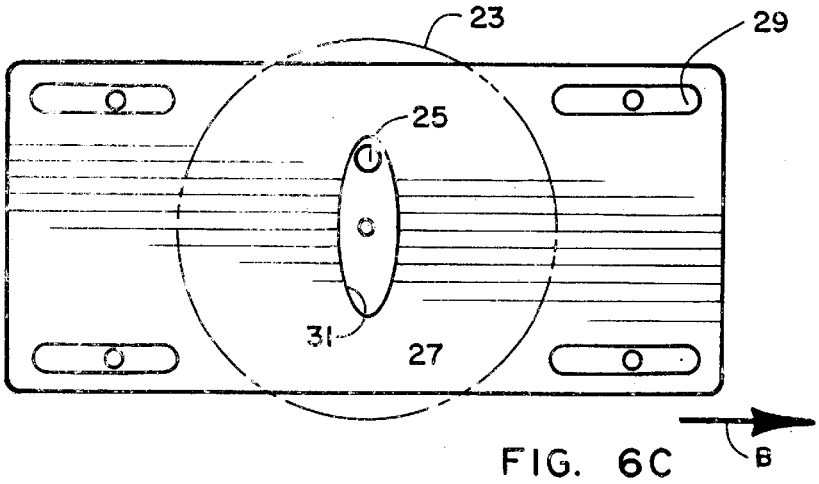
Figure 6D:
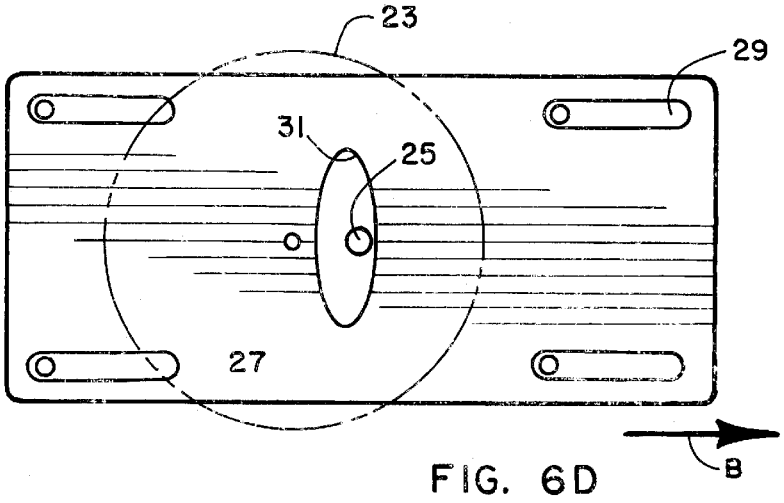

FIGS. 6A to 6D specifically show the position of the movement-plate 27 as the main gear 23 rotates in the direction "R." For the sake of description, the position in FIG. 6A will be considered a starting point and the position in FIG. 6D will be considered an ending point. However, these points may occur in the middle of operation and need not designate actual starting and ending points.

As shown in FIG. 6A, the main gear 23 starts in a position where the drive shaft pin 25 is in the lower portion of the drive-pin slot 31. When the main gear rotates in the direction "R," the drive shaft pin 25 pushes the movement-plate 27 in the direction "A" and moves upward in the drive-pin slot.

As shown in FIG. 6B, when the main gear 23 has rotated 90 degrees, the drive shaft pin 25 will have reached its maximum lateral position in the direction "A," and so will have pushed the movement-plate 27 as far to the direction "A" as possible. At this point, the drive shaft pin 25 will have reached the center of the drive-pin slot 31.

As shown in FIG. 6C, the rotation of the main gear 23 in the direction "R" now causes the drive shaft pin 25 to push the movement-plate in the direction "B" and continues to move upward in the drive-pin slot 31. By the time the main gear has rotated another 90 degrees, the drive shaft pin 25 will have reached the uppermost position in the drive-pin slot 31.

As shown in FIG. 6D, when the main gear 23 has rotated yet another 90 degrees, the drive shaft pin 25 will have reached its maximum lateral position in the direction "B," and so will have pushed the movement-plate 27 as far to the direction "B" as possible. At this point, the drive shaft pin 25 will have again reached the center of the drive-pin slot 31.

As the main gear continues to rotate in the direction "R," the drive shaft pin will return to the position shown in FIG. 6A, and will continue as described above. As a result of this, the movement-plate and the surgical sponge 39 attached to it move back and forth as shown by the arrows marked "A" and "B" in FIG. 3. The speed of lateral movement of the sponge 39 can be regulated by the speed of rotation of the main gear 23, the size and position of the drive-pin slot 31, and the location of the driving shaft pin 25 on the main gear.

In addition, although the use of a main gear 23 with a driving shaft pin 25 is disclosed in both the first and second preferred embodiments, alternate embodiments may be used to provide lateral movement to the movement-plate 27.

While the sponge 39 is moving back and forth, water is supplied via the water line 13. The water passes over the sponge 39 and provides a continuous source of water for sterilizing the users hands. Soap, disinfectant, or antibacterial agents can be provided on the sponge, or by any other desirable means, such as a soap dispenser included in the modular surgical prep sponge holder.

The removable portion 20 can be moved via the swivel head 19 to position the sponge 39 to a wide variety of desirable positions, allowing the sponge 39 adequate access to the entirety of the users arms and hands, improving the chances that they will be adequately cleaned for a surgical procedure.

For ideal operation, two modular surgical prep sponge holders 100 are preferably mounted on the rear counter side of a single sink, or the rear wall of the sink on either sides of an existing faucet. Respective left and right side units will then clean each hand and forearm separately. By having two modular surgical prep sponge holders 100, the effectiveness of the sterilization process is further improved.

By freeing up the user's hands, the modular surgical prep sponge holder of the present invention reduces the possibility for cross contamination. The modular surgical prep sponge holder eliminates the need for one hand to trade the same sponge to the other hand during the cleaning process, and eliminates any need to use one hand to throw away the used sponge.

Prior to the start of the sterile scrub procedure, a sterile removable portion 20 of the modular surgical prep sponge holder 100 is inserted and attached to the flexible shaft attachment 17 or 17*a*. A sterile sponge 39 is then unwrapped and attached to the modular surgical prep sponge holder 100. This sponge 39 need not be handled by the user except as is necessary for cleansing her hands. As a result, the operator never has to transfer or hold an object, i.e., the sponge, that may not be completely sterile.

In a hospital, each removable portion 20 of the modular surgical prep sponge holder 100 will preferably be individually packaged so that they remain sterile until ready for use. This way each time a surgeon or nurse scrubs, they can install two of these devices and insure that they will have a more effective scrubbing procedure.

In addition to avoiding contact with potentially contaminated sponges, the modular surgical prep sponge holder also improves the effectiveness of the scrubbing itself. The sponge or sponges are moved back and forth more rapidly than would be possible by hand. And since this not dependent upon the action of the user, it will be just as fast, with just as many strokes throughout the entire cleansing process.

The modular surgical prep sponge holder moves the sponges in a back and forth scrubbing motion by use of a flexible cable attached to a motor that is capable of delivering up to 10,000-RPMs or more. The flexible cable is attached to the movement apparatus of the device, which is in turn attached to the scrub sponge. By generating a greater number of strokes per minute in the cleaning process than can be generated by hand, the end result is a more uniform, effective, and tireless cleaning procedure. This makes for a more effective and efficient scrubbing method, particularly for cleaning hands, under the fingernails, on the finger tips, along the arms, and in the web spaces. Furthermore, since the user need not perform the back and forth action of the sponge, the duration of the cleansing can be improved without tiring the user.

The device in its preferred implementation appears to form two faucets placed on either side of an existing faucet, remaining in the middle of a typical sink. The units are preferably a little taller than the original sinks faucet. The device can also be mounted to a rear wall or the rear counter of the sink. The added height of the device is desirable to enable the user to perform the surgical prep without having to bend over very far. This makes the prep a comfortable and efficient method of quickly and effectively prepping for surgery.

Although the above embodiments have been described specifically as surgical prep sponge holders, for use in preparing for surgery, it should be clear that this invention can be used in any situation where cleanliness and both speed and ease of hand washing is desirable.

For example, the device disclosed above could be provided in restrooms or sinks in the food preparation and production industry to insure the cleanliness of the hands of people producing, preparing, or serving food. Likewise, anyone in a care-giving position, whether it be a dental office, a nursing home, an emergency room, an ICU, or the like, where cleanliness and the prevention of infection is a concern could benefit from the present invention.

In fact, any industry that requires the washing of hands either before or after work could benefit from this invention. By making hand washing easier, quicker, and more effective, this invention provides and increased incentive for an employee to wash their hands, and an increased effectiveness for such a hand washing.

Furthermore, any situation in which someone must wash their hands, but may be of limited dexterity could benefit from this invention. It would be particularly useful to allow someone with only one hand operative to effectively wash their hand. This could include anyone who has lost a hand, or who simply has one arm temporarily unavailable, e.g., in a cast. But this could also include the elderly, those recuperating from illness, or those with diseases that reduce or limit their manual dexterity. Such people could benefit from the device disclosed above in their own homes or in public restrooms.

The present invention has been described by way of a specific exemplary embodiment, and the many features and advantages of the present invention are apparent from the written description. Thus, it is intended that the appended claims cover all such features and advantages of the invention. Further, since numerous modifications and changes will readily occur to those skilled in the art, it is not desired to limit the invention to the exact construction and operation ad illustrated and described. Hence, all suitable modifications and equivalents may be resorted to as falling within the scope of the invention.

What is claimed is:

1. A modular surgical prep sponge holder comprising:

a movement plate;

a surgical sponge connected to the movement-plate;

a lateral motion generator, which comprises a wheel, a rotational motion generator for moving the wheel in a rotational direction, and a motion transfer device to convert rotational movement of the wheel into lateral movement of the movement-plate for moving the movement-plate and the surgical sponge in a lateral direction, wherein the transfer device comprises a drive shaft pin connected to the wheel, wherein the movement-plate contains a drive-pin slot; and wherein the drive shaft pin is placed within the drive-pin slot to convert the rotational movement of the wheel into the lateral movement of the movement-plate; and a water line for supplying water to the surgical sponge.

2. A modular surgical prep sponge holder, as recited in claim 1, wherein the rotational motion generator can be controlled by the user.

3. A modular surgical prep sponge holder, as recited in claim 1, herein the rotational motion generator comprises a flexible shaft connected to the wheel, and the flexible shaft is rotated to provide the rotational movement of the wheel.

4. A modular surgical prep sponge holder, as recited in claim 1, wherein the rotational motion generator comprises a stream of high-pressure water that pushes against the wheel, causing the wheel to move in the rotational direction.

5. A modular surgical prep sponge holder, as recited in claim 1, wherein the wheel is a main gear.

6. A modular surgical prep sponge holder, as recited in claim 5, wherein the rotational motion generator comprises a pinion gear connected in an interlocking fashion with the main gear; and a flexible shaft connected to the pinion gear, wherein the flexible shaft is rotated to provide rotational movement to the pinion gear, and the rotational movement of the pinion gear is transferred into the rotational movement of the main gear.

7. A modular surgical prep sponge holder, as recited in claim 1, wherein the amount of water supplied to the surgical sponge can be controlled by the user.

8. A modular surgical prep sponge holder, as recited in claim 1, further comprising a soap dispenser for dispensing cleansing agents.

9. A modular surgical prep sponge holder, as recited in claim 1, wherein the movement-plate and the lateral motion generator are placed within an outer housing.

10. A modular surgical prep sponge holder comprising:

a movement plate;

a surgical sponge connected to the movement-plate;

a water line for supplying water to the surgical sponge;

a lateral motion generator, which comprises a main gear, a rotational motion generator which comprises a pinion gear connected in an interlocking fashion with the main gear, a flexible shaft connected to the pinion gear, wherein the flexible shaft is rotated to provide rotational movement to the pinion gear, and the rotational movement of the pinion gear is transferred into the rotational movement of the main gear and a motion transfer device to convert rotational movement of the main gear, into lateral movement of the movement-plate for moving the movement-plate and the surgical sponge in a lateral direction, wherein the flexible shaft and the water line are both contained within a tube housing.

11. A modular surgical prep sponge holder comprising a movement plate;

a surgical sponge connected to the movement-plate;

a lateral motion generator for moving the movement-plate and the surgical sponge in a lateral direction; and a water line for supplying water to the surgical sponge;

a housing cover to protect the movement plate; and a swivel head connected to the housing cover, the swivel head allowing the housing cover to move along 180 degrees of motion.

12. A modular surgical prep sponge holder, as recited in claim 11, wherein the sponge is attached to the movement-plate through the use of spring tension end clasps.

13. A modular surgical prep sponge holder, as recited in claim 11, wherein the lateral motion generator comprises:

a wheel;

a rotational motion generator for moving the wheel in a rotational direction; and a motion transfer device to convert rotational movement of the wheel into lateral movement of the movement-plate.

14. A modular surgical prep sponge holder as recited in claim 13, wherein the transfer device comprises a drive shaft pin connected to the wheel, wherein the movement-plate contains a drive-pin slot, and wherein the drive shaft pin is placed within the drive-pin slot to convert the rotational movement of the wheel into the lateral movement of the movement-plate.

15. A modular surgical prep sponge holder, as recited in claim 13, wherein the rotational motion generator comprises a flexible shaft connected to the wheel, and the flexible shaft is rotated to provide the rotational movement of the wheel.

16. A modular surgical prep sponge holder, as recited in claim 13, wherein the rotational motion generator comprises a stream of high-pressure water that pushes against the wheel, causing the wheel to move in the rotational direction.

17. An apparatus for cleaning, comprising a movement-plate;

a cleaning device connected to the movement-plate;

a lateral motion generator for moving the movement-plate and the cleaning device in a lateral direction; and a water line for supplying water to the cleaning device;

a housing cover to protect the movement plate; and a swivel head connected to the housing cover, the swivel head allowing the housing cover to move along 180 degrees of motion.

18. An apparatus for cleaning, as recited in claim 17, wherein the lateral motion generator comprises:

a wheel;

a rotational motion generator for moving the wheel in a rotational direction; and a motion transfer device to convert rotational movement of the wheel into lateral movement of the movement-plate.

19. An apparatus for cleaning, as recited in claim 17, wherein the cleaning device is a sponge.

20. An apparatus for cleaning, as recited in claim 17, wherein the cleaning device is a brush.

21. An apparatus for cleaning, as recited in claim 17, wherein the cleaning device is a combination of a sponge and a brush.

* * * * *